US005413430A

United States Patent [19]

Schrem et al.

[11] Patent Number: 5,413,430

[45] Date of Patent: May 9, 1995

[54] CLAMPING DEVICE AND A CLAMPING FILE EQUIPPED THEREWITH

[75] Inventors: Kurt Schrem; Herbert Kratzert, both of Pfullendorf; Alexander Benn, Stuttgart, all of Germany

[73] Assignee: Kratzert & Schrem GmbH, Pfullendorf, Germany

[21] Appl. No.: 187,515

[22] Filed: Jan. 28, 1994

[30] Foreign Application Priority Data

Jan. 29, 1993 [DE] Germany ..... 9301246 U

[51] Int. Cl.[6] ..... B42F 13/02; B42D 17/00

[52] U.S. Cl. ..... 402/60; 402/80 R; 281/45

[58] Field of Search ..... 402/8, 9, 19, 14, 15, 402/18, 20, 21, 60, 73, 79, 80 R; 40/658; 281/45, 46

[56] References Cited

U.S. PATENT DOCUMENTS

| | | | |
|---|---|---|---|
| 632,491 | 9/1899 | Hiscock | 402/60 |
| 1,557,550 | 10/1925 | Benson . | |
| 2,605,526 | 8/1952 | Bader | 402/15 |
| 4,402,530 | 9/1983 | Daguerre | 281/45 |
| 4,904,104 | 2/1990 | Gloeckle | 281/45 |
| 5,226,676 | 7/1993 | Su | 281/45 |
| 5,285,952 | 2/1994 | Ho | 281/45 |

FOREIGN PATENT DOCUMENTS

| | | |
|---|---|---|
| 2448443 | 9/1980 | France . |
| 1245904 | 8/1967 | Germany . |
| 2856049 | 6/1980 | Germany . |
| 8910130 | 10/1989 | Germany . |
| 8909998 | 12/1989 | Germany . |
| 8910130 | 12/1989 | Germany . |
| 997128 | 6/1965 | United Kingdom . |

*Primary Examiner*—Hwei Siu Payer

*Attorney, Agent, or Firm*—Evenson McKeown Edwards & Lenahan

[57] ABSTRACT

A clamping device and clamping file for releasably holding sheets of paper or the like is disclosed. The clamping file includes two file covers connected to one another along a folding edge. The clamping device is swivellably fastened to one of the file covers at a window cut-out in the clamping file adjacent the folding edge. The clamping device includes first and second legs connected by a back to form a U-shaped elastic clamp for paper sheets. To facilitate insertion of paper sheets, a longitudinal end area of the clamping device is configured with one of the legs spaced from the other leg to form a paper inserting mouth which is maximally wide at a longitudinal end of one of the legs.

17 Claims, 3 Drawing Sheets

CLAMPING DEVICE AND A CLAMPING FILE EQUIPPED THEREWITH

BACKGROUND OF THE INVENTION

The invention relates to a clamping device for paper sheets of the type having a clamping device, particularly for a clamping file, having an essentially U-shaped cross-section with a first and a second leg connected with one another by way of a back, said legs being elastically pressable apart on their free longitudinal edges to define a clamping gap therebetween for the inserting and clamping-in of one or several paper sheets. The invention also relates to a clamping file which is provided with such a clamping device and has two file covers which are connected with one another along a folding edge.

By means of files of this the, one paper sheet or a plurality of stacked paper sheets may be releasably fastened in the file by means of clamping, without the requirement of carrying out measures on the paper sheets, such as perforating, which often result in undesirable and irreparable changes of the sheets. Clamping devices and clamping files of the initially mentioned type are known, for example, from German Utility Model Documents DE 89 09 989 U1 and DE 89 10 130 U1. In the case of the files of these documents, the clamping device is displaced in a linear uniform motion perpendicularly to the folding edge of the clamping file in the area of its window between a clamping position and a releasing position. So that the clamping device can be held on the file also in the releasing position and cannot be lost, lateral projections or thickenings, which interact with the folding edge, or counterhooking strips are provided along the folding edge area embraced by the clamping device. Even in the releasing position, the clamping device therefore reaches, by means of its clamping free longitudinal edges, around the back file cover as well as a lamellar part arranged on the front side in the window area, along its folding edge. For facilitating the first sliding-on of the clamping device, the free longitudinal edge of the upper leg may be provided with an oblique surface which forms, together with the lower clamp leg, a mouth which opens up in a V-shape and extends along the whole length of the clamping device, the free longitudinal edge of the lower leg projecting beyond that of the upper leg.

In addition, a clamping file is already on the market in which the pertaining clamping device is pivotally connected to the back cover of the file. In the case of the clamping device used here, the free longitudinal edges of the clamp legs, which define the clamping gap between one another, extend at a narrow constant distance from one another along their whole length. The two clamp legs are connected with one another by way of a continuous back, and the lower leg has a lengthening on a face end, which lengthening contains an opening by means of which the clamping device is swivellably held, for example, riveted on, on the back cover of the file. From its clamping position, in which it is situated inside a window cut out of the front cover of the file, the clamping device may be swivelled out by approximately 90° into a releasing position in which it completely releases sheets which were previously clamped in and inserted in the file and, in particular, file parts are no longer situated in the clamping gap between the free longitudinal edges of the clamp legs.

The invention is based on the technical problem of providing a clamping device as well as a clamping file equipped therewith which permits a convenient and trouble-free handling of the clamping device in which the clamping device cannot be lost as well as a releasing of inserted clamped-in sheets in the different usage conditions of the file.

This problem is solved by means of a clamping device wherein the free longitudinal edge of the first leg is formed at a distance from the free longitudinal edge of the second leg in the area of a face-side end as a paper sheet accommodating inserting mouth, which distance increases in the direction of this face-side end.

By the formation of the inserting mouth in the area of the face-side end of a clamp leg, the parts which are to be clamped in can conveniently and reliably be entered into the clamping device without any abutting by the parts to be clamped in against the free longitudinal edges of the legs which define the clamping gap. During continuous use, this abutting may result in damage to the file in its folding-edge-side area.

The arrangement of such an inserting mouth is particularly advantageous in combination with a swivellable connection of the clamping device with the clamping file which is provided as a lengthening of this face-side end, because then the file cover or covers together with the sheets situated in the interior are automatically inserted at the front into the inserting mouth of the clamping device when the clamping device is swivelled from a releasing position into the clamping position. The inserting mouth is therefore used as an insertion aid not only when the clamping position is established for the first time but also in all other subsequent clampings during the use of the clamping file.

In a further development of the invention, the back has a shortened design, whereby a slot is created. As a result, even when the clamping folder is folded open, the clamping device may still be swivelled out of the clamping position so far, for example, by 45°, that the previously clamped-in parts, such as the rear cover of the file, a front-side lamella part and paper sheets disposed in-between, are only still situated in the area of the inserting mouth inside the clamping device so that there is no longer any clamping effect and the sheets may be removed and new sheets may be inserted.

In a further development of the invention, a recess is provided on the back-side longitudinal edge of the leg containing the devices for the swivellable holding. Thus, it is achieved that, also in the folded-over condition of the clamping file in which the two outer sides of the file cover rest against one another, the clamping device can be swivelled out so far, for example, by an angle of between 20° and 50°, that the previously clamped-in parts are only still situated in the area of the non-clamping inserting mouth and the inserted sheets can be exchanged again. When the clamping device is swivelled out, the border of the folding edge which is closer to the swivelling axis and borders on the window area enters into the recess which permits the swivelling-out of the clamping device about an angle required for the release of the sheets. Damage to the folding edge in this area by the swivelling-out of the clamping device is preferably avoided by the fact that, on its side facing the devices for the swivellable holding, the recess is bounded by a linear section of the longitudinal edge of the second leg which is assigned to the back, which section forms an acute angle with the longitudinal direction of the back. This causes a material-saving, line-type striking of this linear clamp section against the folding edge when the clamping device is swivelled out.

For aiding the swivel movement between the clamping position and the releasing position, it is advantageous to arrange handling knobs on the half of the clamping device which faces away from the swivelling axis, which handling knobs provide a gripping surface for the swivelling-out and swivelling-in.

Other objects, advantages and novel features of the present invention will become apparent from the following detailed description of the invention when considered in conjunction with the accompanying drawings.

DETAILED DESCRIPTION OF THE PREFERRED EMBODIMENTS

Figure 2:
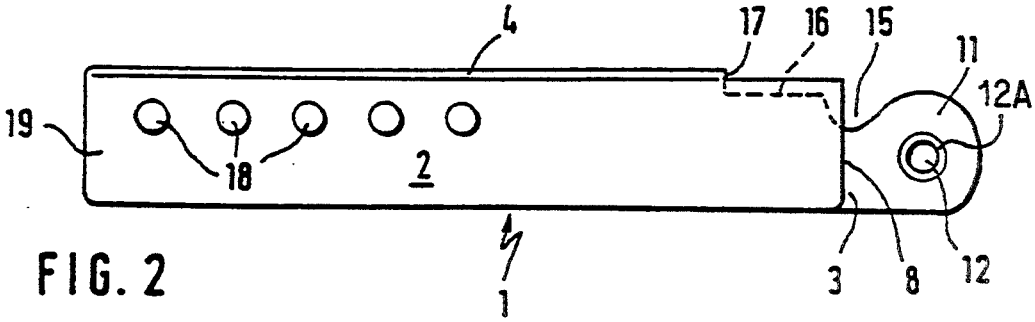
FIG. 2 is a plan view of the clamping device of FIG. 1 from the top.
Figure 3:
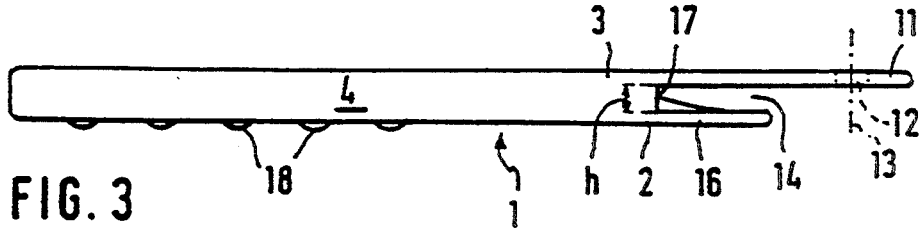
FIG. 3 is a rear view of the clamping device of FIG. 1.
Figure 4:
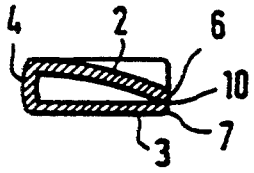
FIGS. 4 to 6 are respective cross-sectional views of the clamping device along Lines IV—IV, V—V and VI—VI in FIG. 1.
Figure 5:
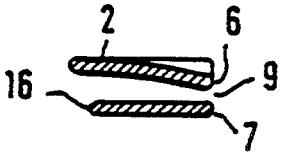
Figure 6:
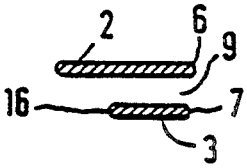

The clamping device 1, which is illustrated separately in FIGS. 1 to 6, has an essentially U-shaped cross-section, as shown particularly in FIG. 4, with a first leg 2 and a second leg 3 which are connected with one another by way of a back 4 along the longitudinal side. Because of the selected material for the clamping device, preferably a plastic material or metal, this connection is elastic in such a manner that the two legs 2, 3, when they are bent apart, create a clamping effect by means of their free longitudinal edges 6, 7, the latter defining between themselves a clamping gap 10 along the largest part of their length.

Figure 1:
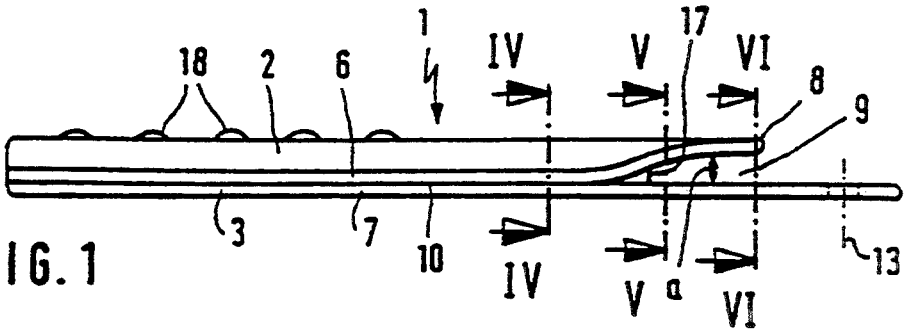
FIG. 1 is a frontal view of a clamping device for the swivel mounting on a clamping file, constructed according to a preferred embodiment of the present invention.

The free longitudinal edge 6 of the first leg 2, in comparison to the free longitudinal edge 7 of the essentially plane, second leg 3, is shaped to be jutting back toward a face-side end 8, whereby the clamping gap 10 is widened to form an inserting mouth 9. As the result of the distance (a) of the two free longitudinal edges 6, 7 from one another which increases continuously toward the face-side end 8 of the first leg 2, the inserting mouth 9 ensures a secure introduction and a subsequent clamping-in of the material to be entered in the clamping gap 10. The gradual widening in the area of the inserting mouth 9 is shown particularly clearly in the cross-sections of FIGS. 4 6. As illustrated in FIG. 1, the inserting mouth 9 extends along a length of approximately 20% of the length of the free longitudinal edge 6 of the first leg 2. The first leg 2, which has an arched construction in the area of the clamping gap 10, finally extends by means its front face 8, which faces the inserting mouth 9, essentially in a plane parallel manner with respect to the second leg 3. The maximal distance of the free longitudinal edges 6, 7 of the clamp legs 2, 3 from one another formed at this face end 8, that is, the opening width of the inserting mouth 9, corresponds approximately to the height (h) of the back 4 connecting the legs 2, 3, as indicated in FIGS. 1 and 3.

The second leg 3 is lengthened beyond the face end 8 of the first leg 2, in which case this lengthening 11 has, as a device for a swivellable holding of the clamping device, an opening 12, through which, for example, a riveted sleeve can be fitted as the bearing, after which the clamping device can be swivelled about an axis 13 which is perpendicular to the plane of the second leg 3.

As illustrated particularly in FIG. 3, the back 4, which connects the two legs 2, 3, does not extend to the face end 8 of the first leg situated on the inserting mouth 9 but already ends at a distance from it approximately at the level at which the clamping gap 10 on the front side of the clamping device changes over into the inserting mouth 9. As a result, a correspondingly deep slot 14 is formed between the two legs 2, 3 on their back side.

At the level between the back end 17 bounding the slot 14 and the opening 12 for the swivellable clamping holding, the rearward longitudinal edge 16 of the second leg 3 is provided with a semicircular recess 15, approximately at the level of the face end 8 of the first leg 2, as indicated particularly clearly in FIG. 2.

A plurality of knobs 18 are provided on the upper side of the first leg 2 in the area of the leg half 19 facing away from the inserting mouth 9.

The advantages of the correspondingly constructed clamping device, when it is used in a clamping file, become particularly clear in the following description of FIGS. 7 to 11, which illustrate a clamping file 20 comprising this clamping device 1 in various operating positions.

Figure 7:
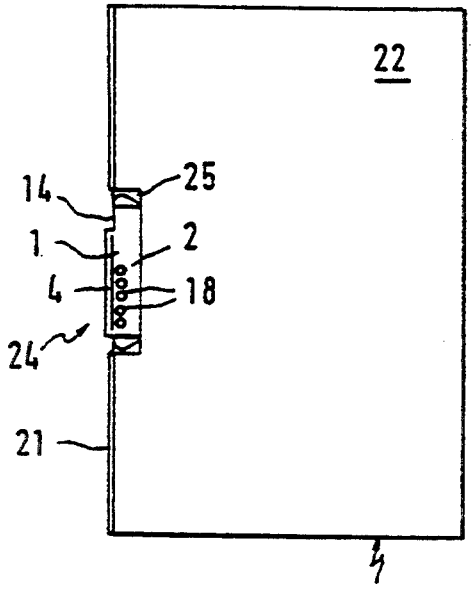
FIG. 7 is a front view of a clamping file equipped with the clamping device according to FIGS. 1 to 6, which clamping file is in the closed condition and in the clamping position of the clamping device.
Figure 8:
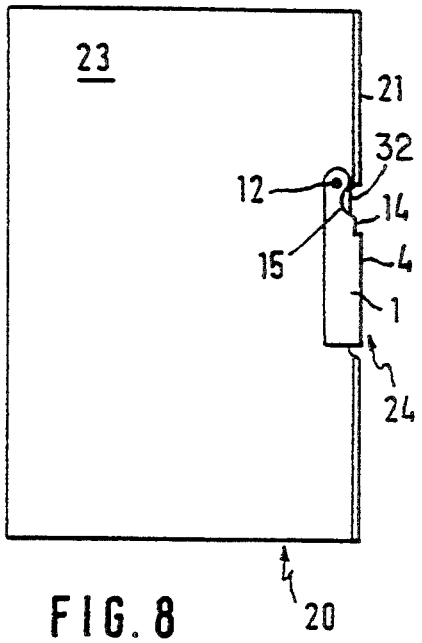
FIG. 8 is a rear view of the clamping file of FIG. 7.

FIGS. 7 and 8 are frontal and rear views of the closed clamping file 20 which is constructed of a front file cover 22 and of a back file cover 23 which are each preferably made of plastic or cardboard and which are connected with one another along a folding edge 21 in a foldable manner. The clamping device 1 described in FIGS. 1 to 6 is fixed in a swivellable manner on the back file cover 23 by means of a rivet which reaches through the opening 12. The clamping device 1 is in its clamping position 24 in which the first upper leg 2 is situated inside a window 25 which forms a strip and is cut out approximately in the center in the front file cover 22 along the folding edge 21, so that the back 4 of the clamping device 1 extends approximately along the folding edge 21.

Figure 9:
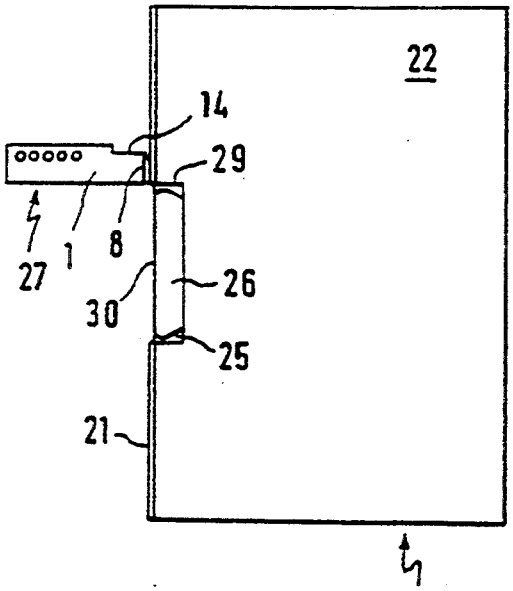
FIG. 9 is a frontal view of the clamping file of FIG. 7 with the clamping device in a first releasing position.

FIG. 9 is a plan view of the clamping folder 20 also in the folded-shut condition; however, when the clamping device 1 is swivelled out of the clamping position 24 into a—first—releasing position 27. Although, because of the rearward slot 14, a further swivelling-out would be possible, the releasing position 27 achieved by a swivelling about 90° is particularly advantageous because then the face side 8 of the shorter first leg 2, which faces the swivel opening 12, comes to be situated in parallel outside the folding edge 21, whereby the front file cover 22 can be folded open not only in the clamping position 24 but also in this first releasing position of the clamping device 1 for the purpose of opening the file 20 by 180° along the folding edge 21, after which the content of the file will be loose and can be viewed in a complete manner.

Figure 10:
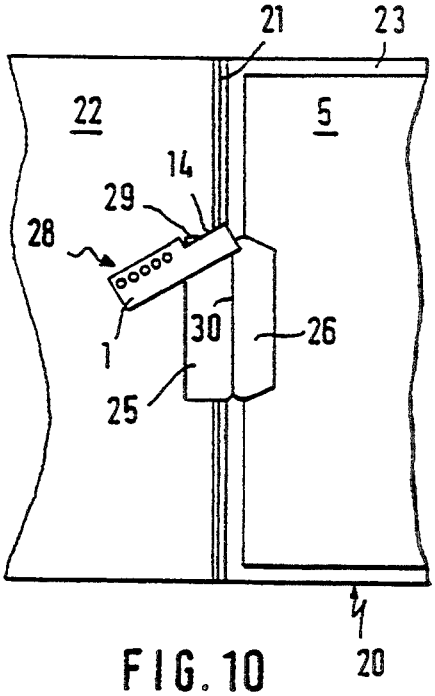
FIG. 10 is a partially cut-away plan view of the center area of the folded-open clamping file of FIG. 7 with the clamping device in a second releasing position.
Figure 11:
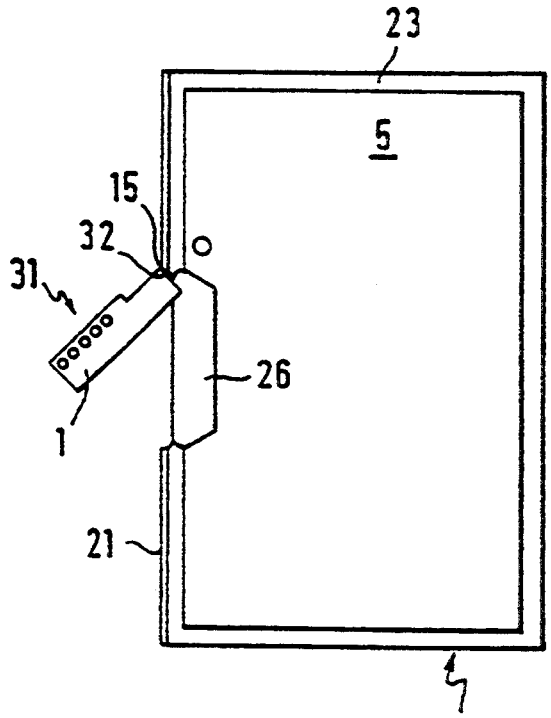
FIG. 11 is a plan view of the clamping file of FIG. 7 with the folded-over front file cover and the clamping device in a third releasing position.

This FIG. 9 as well as FIGS. 10 and 11 illustrate particularly clearly the presence of a lamella part 26 which is formed in one piece with the file covers 22, 23 by being cut out of the front file cover 22, whereby the window 25 is formed in the first file cover 22. The lamella part 26 is used as a sliding aid for the clamping device 1 which is to be swivelled into the window area for the purpose of clamping in one paper sheet 5 or a plurality of paper sheets 5 forming a stack, so that, in the clamping position 24, the second lower clamping leg 3 reaches around the back file cover 23 and the front first clamp leg 2 reaches around the lamella part 26.

In this case, the clamping device 1 presses the lamella part 26, which in the area of the file folding edge 21 is connected along a connecting line 30 in a foldable manner with the back file cover 23, against this file cover 23 or against the one or the plurality of paper sheets 5 which are slid in between the lamella part 26 and the back file cover 23, the connecting line 30 of the lamella part 26 and the back file cover 23 being used as a stop. It should be noted that, after the clamping device 1 has been brought into the releasing position 27 indicated in FIG. 9 and the front file cover 22 is then folded open, the lamella part 26 is not longer acted upon by the clamping device 1 and, if necessary, can also be freely folded over, after which the inserted sheet or sheets 5 can be viewed and handled with respect to their whole surface. By the swivelling-in of the clamping device 1, the stack of sheets 5 can then be held in the file 20 again in a clamped-in manner.

If the front file cover 22 is folded open when the clamping device 1 is in the clamping position 24, in this opened condition of the clamping file 20, a swivelling of the clamping device 1 out of the clamping position 24 into a—second—releasing position 28 is also possible. As illustrated in FIG. 10, the back file cover 23 and the lamella part 26 are embraced by the clamping device 1 only by its non-clamping inserting mouth 9 so that, also in this position 28 of the clamping device 1, the paper sheet or sheets 5 are disposed loosely between the lamella part 26 and the back file cover 23 and can be taken out or additional sheets can be added. This releasing swivelling-out of the clamping device 1 by at least approximately 45° is achieved by the rearward slot 14 of the clamping device 1. In this case, the upper transverse boundary 29 of the window 25 is received by the slot 14 without striking against the back 4, and the clamping device 1 can be swivelled out until the set-back back end 17 comes to rest against the assigned corner area of the window 25. The thus achieved second releasing position 28, as mentioned above, is sufficient for permitting the release of the paper 5 which was previously securely held by being clamped in. It is clear that, also in this case, it is possible to again clamp in the paper sheet or sheets 5 by the swivelling of the clamping device 1 into its clamping position 24.

Finally, the disclosed use of the clamping device 1 for the clamping file 10 allows a swivelling of the clamping device 1 between the clamping position 24 and a—third—releasing position 31; that is, the releasing and new clamping-in of paper 5 resting on the back file cover 23, also in the folded-over condition of the clamping file 20, in which the front file cover 22 is folded around by 360° along the folding edge 21 so that the respective outer sides of both file covers 22, 23 come to rest against one another. Also in,this third releasing position 31—as illustrated in FIG. 11—the clamping device 1 is swivelled out of the clamping position 24 by approximately 45° which, as indicated above, is sufficient for releasing the paper sheet or sheets 5 from the clamping effect, which occurs only in the area of the clamping gap 10 but not in the area of the inserting mouth 9 and to allow their removal or insertion. When the clamping device 1 is swivelled out of the clamping position 24 into the third releasing position 31, the upper, window-side folding-edge border 32 is received by the semicircular recess 15 at the lower second clamping leg 3, which is what permits the swivelling of the clamping device 1 when the file cover 22 is folded around, and prevents damage to the folding edge 21 in this area by a violent swivelling-out of the clamping device 1.

In the case of the described embodiment, a clamping-in and a releasing of the inserted paper can therefore advantageously be achieved in the folded-together, in the folded-open and in the folded-around condition of the clamping file, in which case the inserting mouth 9 aids the inserting of the lamella part 26, of the back file cover 23 and of the paper 5 situated in-between and also limits the clamping gap 10 to the extent that its clamping effect on the inserted paper sheets 5 is already released during a swivelling-out by approximately 45°, as possible in the folded-open and the folded-around condition of the clamping file.

Figure 12:
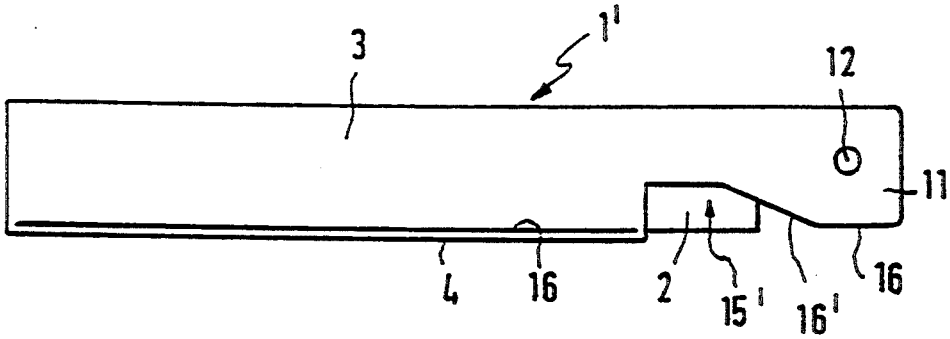
FIG. 12 is a plan view from below of another clamping device for the swivel mounting of a clamping file.

The use of a clamping device 1' illustrated in FIG. 12 which is slightly modified with respect to that of FIGS. 1 to 6 permits a swivelling-out of the clamping device 1' which only minimally stresses the upper folding edge border 32 of the clamping file 20, if this clamping device is mounted on the clamping folder 20 analogously to the above-mentioned clamping device 1. In its design, clamping device 1' according to FIG. 12 corresponds largely to the above-mentioned clamping device 1, in which case functionally identical parts have the same reference numbers. The clamping device 1' according to FIG. 12 is different with respect to the shape of the recess 15' which, in this case, is not indented in a semicircular shape, but has the design which is clearly illustrated in FIG. 12. It is particularly important in this case that, in the direction of the opening 12 for the swivellable clamp holding, the recess 15' is bounded by a linear section 16' of the longitudinal edge 16 of the second leg 3 which is assigned to the back 4, which section, however, forms an acute angle with respect to the longitudinal direction of the back 4. This angle amounts to approximately 35 degrees and may, as an alternative, also have a different value, preferably a value between 20 and 50 degrees.

When the clamping device 1' is pivotally connected to the clamping file 20, and when the clamping folder 20 is folded around corresponding to FIG. 11 and when the clamping device 1' is swivelled out in the releasing position, this diagonally extending longitudinal edge section 16' will extend in parallel to the folding edge 21 of the clamping file 20. Since, in the swivelled-in, clamping condition of the clamping device 1', the back 4 extends in parallel to the folding edge 21, the acute angle between the longitudinal direction of the back and the diagonal longitudinal edge section 16' will correspond to that angle about which the clamping device 1' can be swivelled out in the folded-around condition of the clamping file 20. This angle of—as indicated above—between 20 and 50 degrees which in the case of the clamping device according to FIG. 12 amounts to approximately 35 degrees is selected such that the paper in the clamping folder 20 which is clamped in when the clamping device 1' is swivelled in, is released when the clamping device 1' is swivelled out. The parallel course of the diagonal longitudinal edge section 16' with respect to the folding edge 21 when the clamping device 1' is swivelled out and when the clamping file 20 is folded around, has the effect that the clamping device 1' comes to rest against the folding edge 21 along this whole longitudinal edge section 16' and therefore not only in a punctiform manner, when the folding edge 21, during the swivelling-out of the clamping device 1', is received by the recess 15'. In particular, this prevents a punctiform stressing of the upper window-side folding edge border and thus its early wearing-out. In contrast, when the clamping device 1' is swivelled out, the force is absorbed by the whole diagonal longitudinal edge section 16' and the assigned area of the folded-around folding edge 21. Otherwise, the function of this clamping device 1', which can be provided as an alternative, corresponds completely to that of the above-described clamping device 1.

Naturally, it is possible for a person skilled in the art to carry out obvious modifications in the scope of the invention, possibly while doing without one or several of the above-mentioned advantages. Thus, in a technical reversal, instead of the slot on the clamp back, a window may be provided which is enlarged in this area along the folding edge and/or, instead of the back-side recess on one clamp leg, a separating of the folding edge may be provided which adjoins the window area. In addition, if necessary, the clamping device may be fixed on the front file cover or on both file covers or, when a swivellable holding is eliminated, can be slid freely from the side of the inserting mouth onto the clamping file.

Although the invention has been described and illustrated in detail, it is to be clearly understood that the same is by way of illustration and example, and is not to be taken by way of limitation. The spirit and scope of the present invention are to be limited only by the terms of the appended claims.

What is claimed is:

1. A clamping file assembly comprising:

two file covers connected with one another along a folding edge, and a clamping device fastened to at least one of the file covers at a narrow distance from the folding edge by means of a swivellable holding connection, said clamping device having an essentially U-shaped cross-section with a first and second leg connected with one another by way of a back, said legs being elastically pressable apart on their free longitudinal edges to define a clamping gap therebetween for the inserting and clamping-in of paper sheets, wherein the free longitudinal edge of the first leg is formed at a distance from the free longitudinal edge of the second leg in the area of face-side longitudinal ends of the first and second legs as a paper sheet inserting mouth, which distance increases in a direction toward the face-side ends and, wherein a face-side end of the back adjacent the inserting mouth is shortened with respect to the face-side ends of the legs so that a slot is formed between face-side ends of the first and second legs.

2. A clamping file assembly according to claim 1, wherein said clamping device extends behind one of file covers in a clamping position of the clamping device by means of the second leg.

3. A clamping file assembly according to claim 2, wherein the clamping device is swivellably fastened to one of said file covers and a window is recessed on the other of said file covers along the folding edge, the first leg of the clamping device being situated in the window in the clamping position.

4. A clamping file assembly according to claim 3, wherein a lamella part is fastened in a foldable manner along the folding edge, while extending at least partially into the area of the window, said lamella part being situated between the first leg and the clamped-in sheets in the clamping position of the clamping device.

5. A clamping file assembly according to claim 4, wherein the lamella part is cut out of one of the file covers and forms the window.

6. A clamping file assembly according to claim 1, wherein a recess is provided on a longitudinal edge of the second leg adjacent the back.

7. A clamping file assembly according to claim 6, wherein the recess is bounded by a linear section of the longitudinal edge of the second leg which is adjacent the back, the linear section forming an acute angle with a longitudinal direction of the back.

8. A clamping device for a clamping file, having an essentially U-shaped cross-section with a first and a second leg connected with one another by way of a back, said legs being elastically pressable apart on their free longitudinal edges to define a clamping gap therebetween for the inserting and clamping-in of paper sheets, wherein the free longitudinal-edge of the first leg is formed at a distance from the free longitudinal edge of the second leg in the area of face-side longitudinal ends of the first and second legs as a paper sheet inserting mouth, which distance increases in the direction toward these face-side ends, and wherein a face side end of the back adjacent the inserting mouth is shortened with respect to the face-side ends of the first and second legs so that a slot is formed between the face-side ends of the first and second legs.

9. A clamping device according to claim 8, wherein the second leg has a lengthening at its end adjacent the inserting mouth, means for holding the clamping device to a file cover being provided on the lengthening which can be swivelled about an axis which is perpendicular with respect to the plane of the second leg.

10. A clamping device according to claim 9, wherein a plurality of knobs are provided on the upper side of the first leg in an area of a leg half facing away from the inserting mouth.

11. A clamping device according to claim 8, wherein a recess is provided on a longitudinal edge of the second leg adjacent the back.

12. A clamping device according to claim 11, wherein, the recess is bounded by a linear section of a longitudinal edge of the second leg which is adjacent to the back, the linear section forming an acute angle with a longitudinal direction of the back.

13. A clamping device according to claim 12, wherein a plurality of knobs are provided on the upper side of the first leg in an area of a leg half facing away from the inserting mouth.

14. A clamping device according to claim 8, wherein a plurality of knobs are provided on the upper side of the first leg in an area of a leg half facing away from the inserting mouth.

15. A clamping device for a clamping file, having an essentially U-shaped cross-section with a first and a second leg connected with one another by way of a back, said legs being elastically pressable apart on their free longitudinal edges to define a clamping gap therebetween for the inserting and clamping-in of paper sheets, wherein the free longitudinal edge of the first leg is formed at a distance from the free longitudinal edge of the second leg in the area of face-side longitudinal ends of the first and second legs as a paper sheet inserting mouth, which distance increases in a direction toward these face-side ends.

wherein a recess is provided on a longitudinal edge of the second leg adjacent the back.

16. A clamping device according to claim 15, wherein the recess is bounded by a linear section of the longitudinal edge of the second leg which is adjacent the back, the linear section forming an acute angle with a longitudinal direction of the back.

17. A clamping device according to claim 16, wherein a plurality of knobs are provided on the upper side of the first leg in an area of a leg half facing away from the inserting mouth.

* * * * *